United States Patent [19]

Rotman et al.

[11] 4,381,509

[45] Apr. 26, 1983

[54] CYLINDRICAL MICROWAVE LENS ANTENNA FOR WIDEBAND SCANNING APPLICATIONS

[75] Inventors: Walter Rotman, Boston; Peter R. Franchi, Winchester, both of Mass.

[73] Assignee: The United States of America as represented by the Secretary of the Air Force, Washington, D.C.

[21] Appl. No.: 237,020

[22] Filed: Feb. 23, 1981

[51] Int. Cl.[3] ..... H01Q 3/24; H01Q 15/06

[52] U.S. Cl. ..... 343/754; 343/854

[58] Field of Search ..... 343/754, 854, 909

[56] References Cited

U.S. PATENT DOCUMENTS 4,268,831 5/1981 Valentino et al. ..... 343/854

4,348,678 9/1982 Thomas ..... 343/754

OTHER PUBLICATIONS

"Wide-Angle Microwave Lens for Line Source Applications", W. Rotman et al.-Nov. 1963 IEEE Transaction on Antennas and Propagation.

*Primary Examiner*—Eli Lieberman

*Attorney, Agent, or Firm*—Donald J. Singer; Willard R. Matthews

[57] ABSTRACT

The bandwidth limitation in space fed phased arrays (that results from the use of phase shifters to implement beam steering) is overcome by a lens arrangement in which independent feeds are provided at the focal plane of the lens. Each feed generates a collimated beam in a different spatial direction. Each beam can then be steered about its central position by means of phase shifters, while retaining a substantially improved bandwidth. An algorithm is derived for designing three-dimensional (3D) microwave lenses with line source feeds by stacking a number of identical two-dimensional (2D) parallel-plate, wide-angle constrained lenses into a cylindrical antenna structure. This lens design provides focused beams over a wide range of scan angles in both elevation and azimuth with only small optical aberration. A wide variety of lens designs can be achieved through this algorithm, dependent upon the constraints which are selected for the 2D lens counterpart. For one design, where all the transmission line lengths in the lens are made equal, the phase errors for beam scanning in the plane containing the cylindrical axis of the antenna are less than their broadside values, regardless of scan angle. This permits wide-angle coverage in both elevation and azimuth from a single lens with both good beam and quality and bandwidth.

6 Claims, 12 Drawing Figures

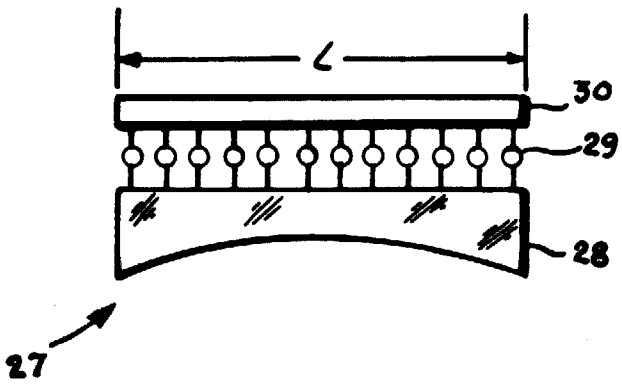
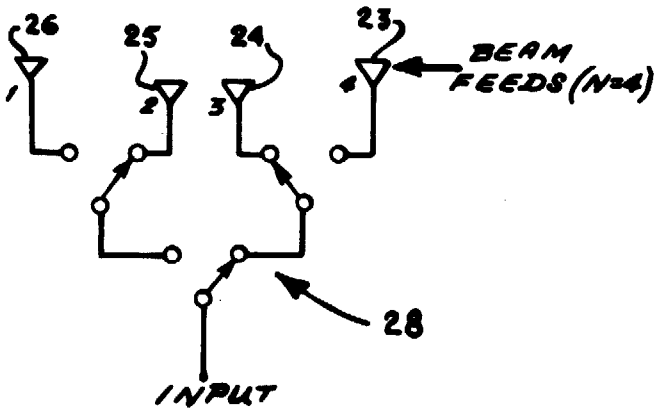
FIG. 3
FIG. 4
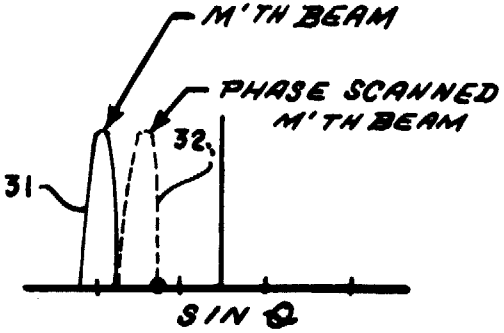
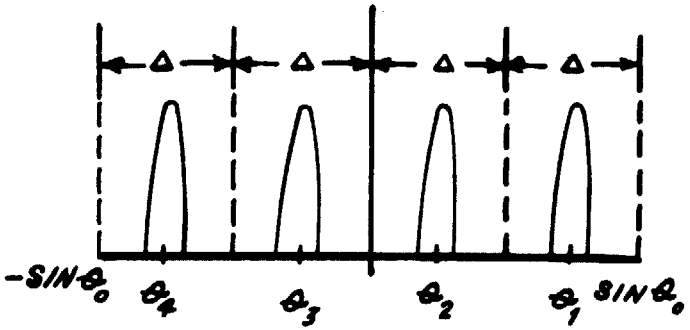
FIG. 5

FIG. 8
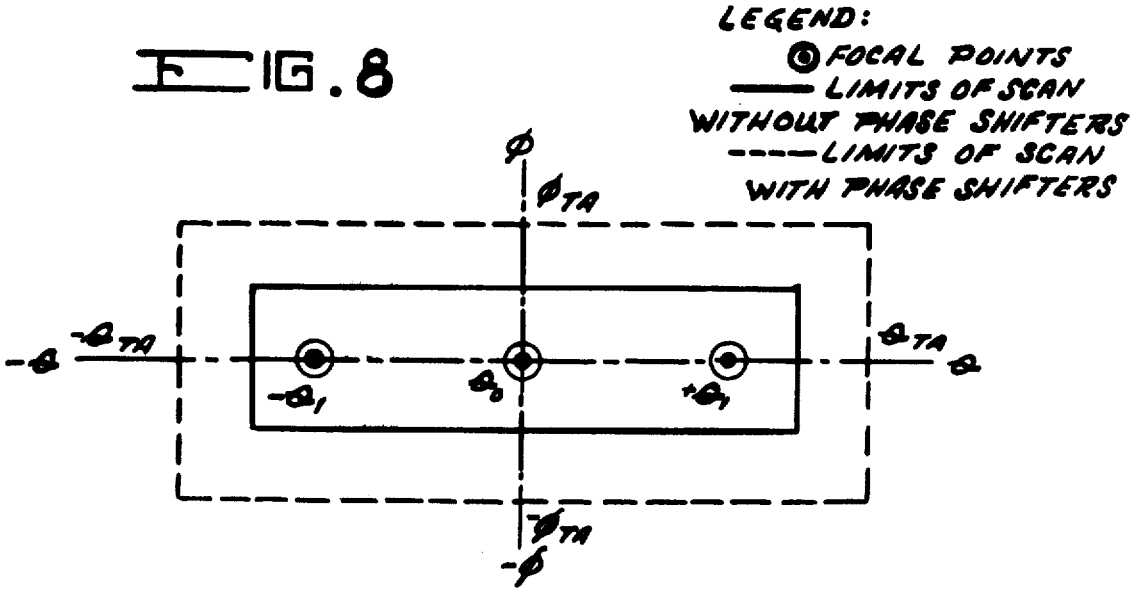
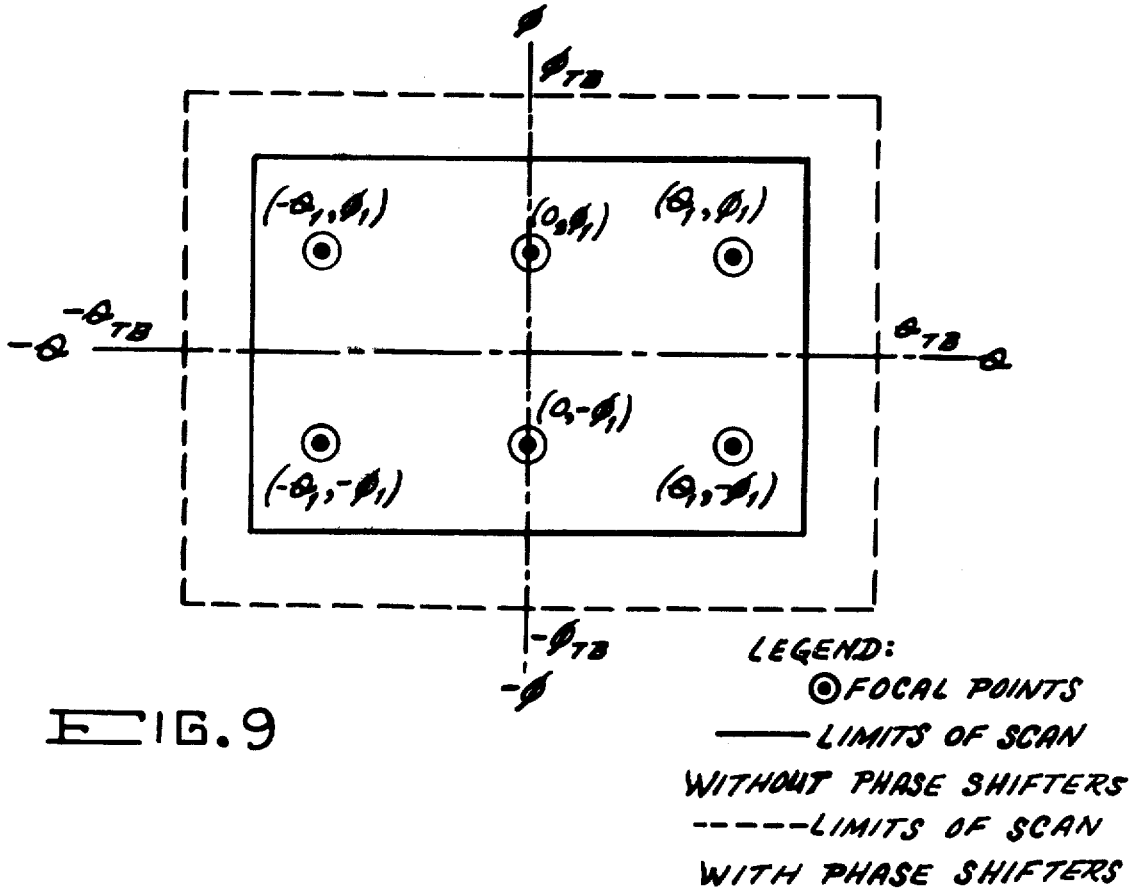
FIG. 9

COORDINATES
$O_1$ @ (0,0,0)
$O_2$ @ (A, 0, 0)
$F_1$ @ $(-F\cos\alpha, -F\sin\alpha, 0)$
$F_2$ @ $(-F\cos\alpha, -F\sin\alpha, -F\tan\beta)$
$P_1$ @ $(X_1, Y_1, Z_1)$
Q @ $(\Xi, N_1, Z_1)$
$\overline{QM}$ // TO $\overline{F_2O_2}$
$\overline{QM}$ ⊥ TO WAVEFRONT
$\gamma = 90° - \beta$

CYLINDRICAL MICROWAVE LENS ANTENNA FOR WIDEBAND SCANNING APPLICATIONS

STATEMENT OF GOVERNMENT INTEREST

The invention described herein may be manufactured and used by or for the Government for governmental purposes without the payment of any royalty thereon.

BACKGROUND OF THE INVENTION

This invention relates to microwave space fed phased array antennas and, in particular, to a three-dimensional cylindrical microwave lens antenna for wideband scanning applications.

Microwave space fed antenna arrays which are capable of directively radiating wideband radio signals and steering their beams over a wide range of angles in both azimuth and elevation are widely utilized in tactical and strategic radar and surveillance systems, wideband microwave communication systems, radio aids for navigation and as electronic counter-measures antennas.

Conventional phased array antennas radiate a single directive beam which is steered by means of phase shifters located at each radiating element. However, the bandwidth of these arrays is limited since phase shifters are not true time delay units, which would be required for proper bandwidth compensation of path length differences encountered during beam scanning.

Current methods for overcoming this bandwidth limitation involve sub-arraying or dividing the aperture into sub units. This requires a limited number of time delay units combined with a large number of phase shifters at the radiating element level. This approach has not been wholly satisfactory, however, since the time delay units are complex and contribute to high insertion losses and high side lobes in the antenna.

Other state-of-the-art systems that require wide angle scan in both azimuth and elevation with wideband performance often use stacks of bootlace lenses feeding an orthogonal set of similar lenses. Unfortunately, for moderate to high gain antennas this arrangement can be very bulky, expensive, complex, unreliable and heavy.

Accordingly, there currently exists the need for a space fed phased antenna array which can scan a directive beam in azimuth and elevation without using complex time delay units at each radiating element and without the usual bandwidth restrictions in phased arrays caused by path length differences during scan. The present invention is directed toward satisfying that need.

SUMMARY OF THE INVENTION

The invention comprises a cylindrical constrained microwave lens antenna which can generate highly focused, multiple, independent beams from line source feeds over a wide scanning range in both azimuth and elevation. For wideband operation a beam is generated in the general direction of the desired scan sector through the selection of an appropriately located line source feed and then scanned over a limited region of space by means of phase shifters at the radiating elements. Other spatial regions are similarly scanned by switching to their corresponding feeds. By this means path length differences in the lens, which must be compensated by the phase shifters, are minimized and the bandwidth is increased in proportion to the number of independent feed positions. In a second embodiment an independent feed position may be provided for each possible beam position, eliminating the need for the phase shifters. Finally, a procedure has been developed whereby the 3D cylindrical lens, scanning in both azimuth and elevation, may be designed on the basis of a 2D constrained, planar lens prototype which scans in the azimuth plane only. A simple algorithm, which relates the path length errors in the 3D cylindrical lens to those in the 2D lens, shows that these errors are independent of the elevation scan angle if the transmission line lengths in the lens are all equal.

In a specific embodiment of the invention four feed horns are equally spaced along the focal arc of a two-dimensional microwave constrained lens (azimuth scan only). Energy from a transmitter can be directed to any one of the horns by means of a switching tree. Each horn, in turn, forms a beam in a different azimuth direction for the zero phase shifter setting. When a linear phase shift is added to the aperture illumination by phase shifters, the beam scans to either side of its zero phase shift position. Extended angular coverage can then be obtained by dividing the scan sector into subregions, each with its own feed horn.

The invention also comprehends a 3D lens antenna which is derived as a vertical stack of identical 2D parallel-plate constrained lenses. Its outer surface then becomes a planar array (or, more generally, an array on a cylindrical surface) of radiating elements. The feed horns, or point source feeds, in the 2D lens are replaced by line source feeds, oriented parallel to the cylindrical axis of the lens, where the azimuth scan angle $\phi$ is determined by the feed's position on the focal surface. Each line source is progressively phased along its length which radiates a cylindrical wave front tilted relative to the horizontal by the desired elevation angle $\phi$. This corresponds to rays emitted from a point on the line source all lying on the surface of a cone with vertical axis and half angle of 90°-$\phi$. The 3D lens is then designed to focus these rays to corresponding azimuth and elevation angles.

The 3D lens design depends upon a correspondence between its rays and those of a 2D lens. Equality between the central ray and a general ray from a focal point in a 2D lens gives the relation (FIG. 10)

$$\overrightarrow{F_1P}+(\tilde{W}-\tilde{W}_o)-(\Xi-A)\cos\alpha+N\sin\alpha=F \quad (1)$$

The corresponding relation for the 3D lens is:

$$F_1P+(\tilde{W}-\tilde{W}_o)\sec\beta-(\Xi-A)\cos\alpha+N\sin\alpha=F \quad (2)$$

Here, $\alpha$ is the azimuth angle and $\beta$ the elevation angle for the radiated beam. Comparison of these two equations shows that they are identical under the transformation $$W=(W-W_o)=(W-W_o)\cos\beta \quad (3)$$

The design for a 3D cylindrical lens is then obtained from an equivalent 2D lens design by changing the transmission line lengths $\tilde{W}$ to new values W in accordance with equation 3. The transformation does not change the shape of either the inner or outer lens contours and applies to any 2D constrained lens prototype which may be described by a set of equations of the form of equation 1.

For line source feeds which are not located at the focii, an expression is derived related the path length errors $\tilde{\Delta L}$ in a cylindrical 3D lens to the path length errors $\Delta L_{2D}$ in its 2D lens prototype:

$$\tilde{\Delta L} = \Delta L_{2D} \cos \beta + (W - W_o)(\cos \beta_o - \cos \beta) \quad (4)$$

Here, $\beta_o$ is the elevation angle for which the 3D lens is designed and $\beta$ the operating elevation angle. Equation 4 provides a simple method of evaluating the errors in a 3D lens from a description of its 2D prototype. In particular, if the transmission lines are all made equal in length ($W = W_o$), then the path length errors in the 3D lens for any elevation angle are less than those for the equivalent 2D lens.

It is a principal object of the invention to provide a new and improved cylindrical microwave lens antenna for wideband scanning applications.

It is another object of the invention to provide a moderate to high gain space fed phased antenna array with wide angle scan capability that is not subject to the bulk, cost, complexity and reliability limitations inherent in stacked bootlace lens type devices.

It is another object of the invention to provide a space fed phased antenna array that is not subject to high insertion losses and high side lobes.

It is another object of the invention to provide a space fed phased antenna array that can scan a directive beam in azimuth and elevation without using complex time delay units at each radiating element and without the usual bandwidth restrictions in phased arrays caused by path length differences during scan.

These together with other objects, features and advantages will become more readily apparent from the following detailed description when taken in conjunction with the illustrative embodiments in the accompanying drawings.

DESCRIPTION OF THE DRAWINGS

FIG. 3 is a schematic representation of one embodiment of the microwave lens array of the invention;

FIG. 4 is a graph showing phase shifter adjustment of beam position;

FIG. 5 is a graph showing scanning by beam selection;

FIG. 8 is a plot for cylindrical lens design for azimuth focussing;

FIG. 9 is a plot for cylindrical lens design for azimuth and elevation focussing;

DETAILED DESCRIPTION OF THE PREFERRED EMBODIMENTS

The apparatus of the invention, in general, comprises a cylindrical constrained microwave wide angle lens antenna, a plurality of feed elements positioned on the focal arc of the lens antenna to illuminate its pickup elements and switching means for selectively connecting feed elements to a transmitter. Phase shifters are included to control each lens radiating element. The basic concept of the invention is to select one of the beams in the wide angle microwave lens antenna (each beam being properly focussed to point in different directions in the absence of phase shifters) and then scanning the selected beam about its zero phase shift position by means of the phase shifters at each radiating element in the lens.

Figure 1:
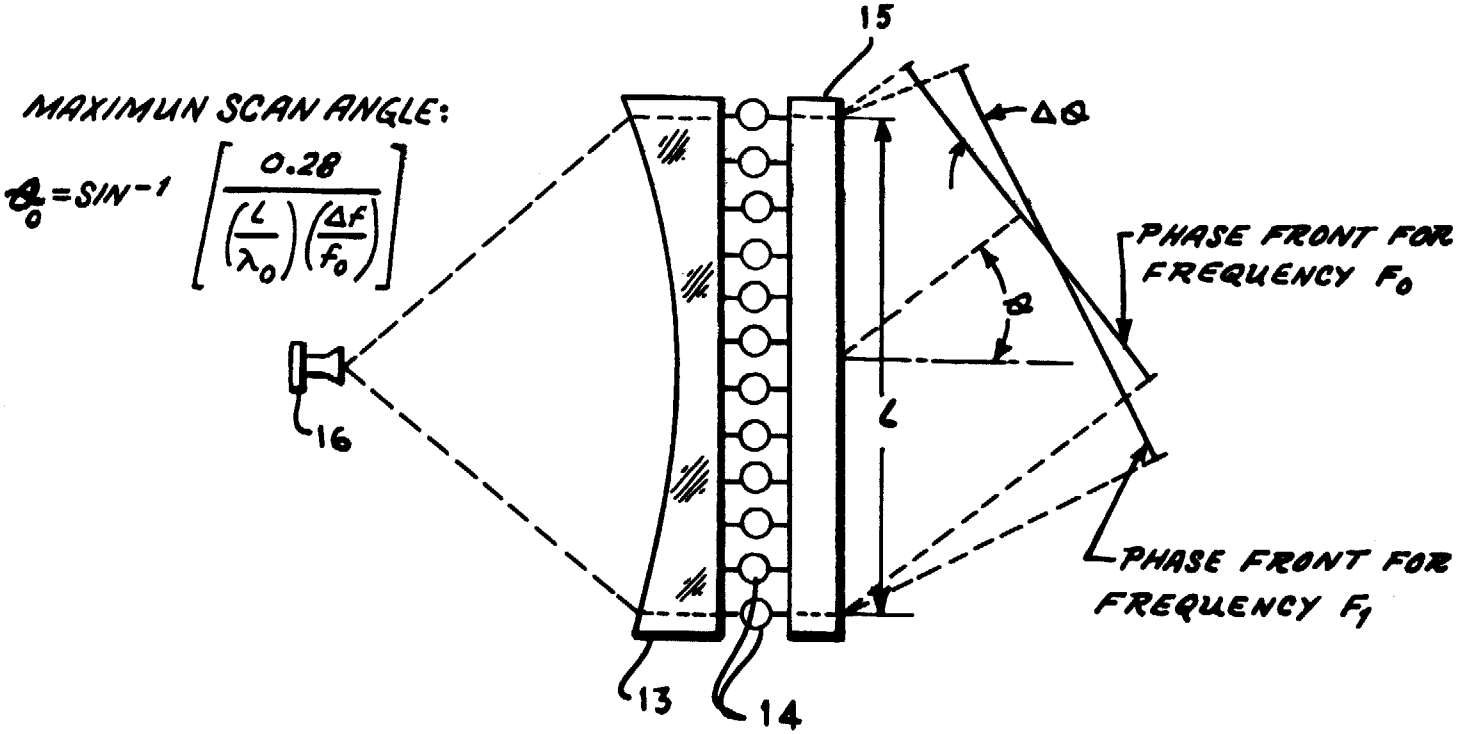
FIG. 1 schematically illustrates a microwave lens and indicates the bandwidth limitations of a space fed phased array.
Figure 2:
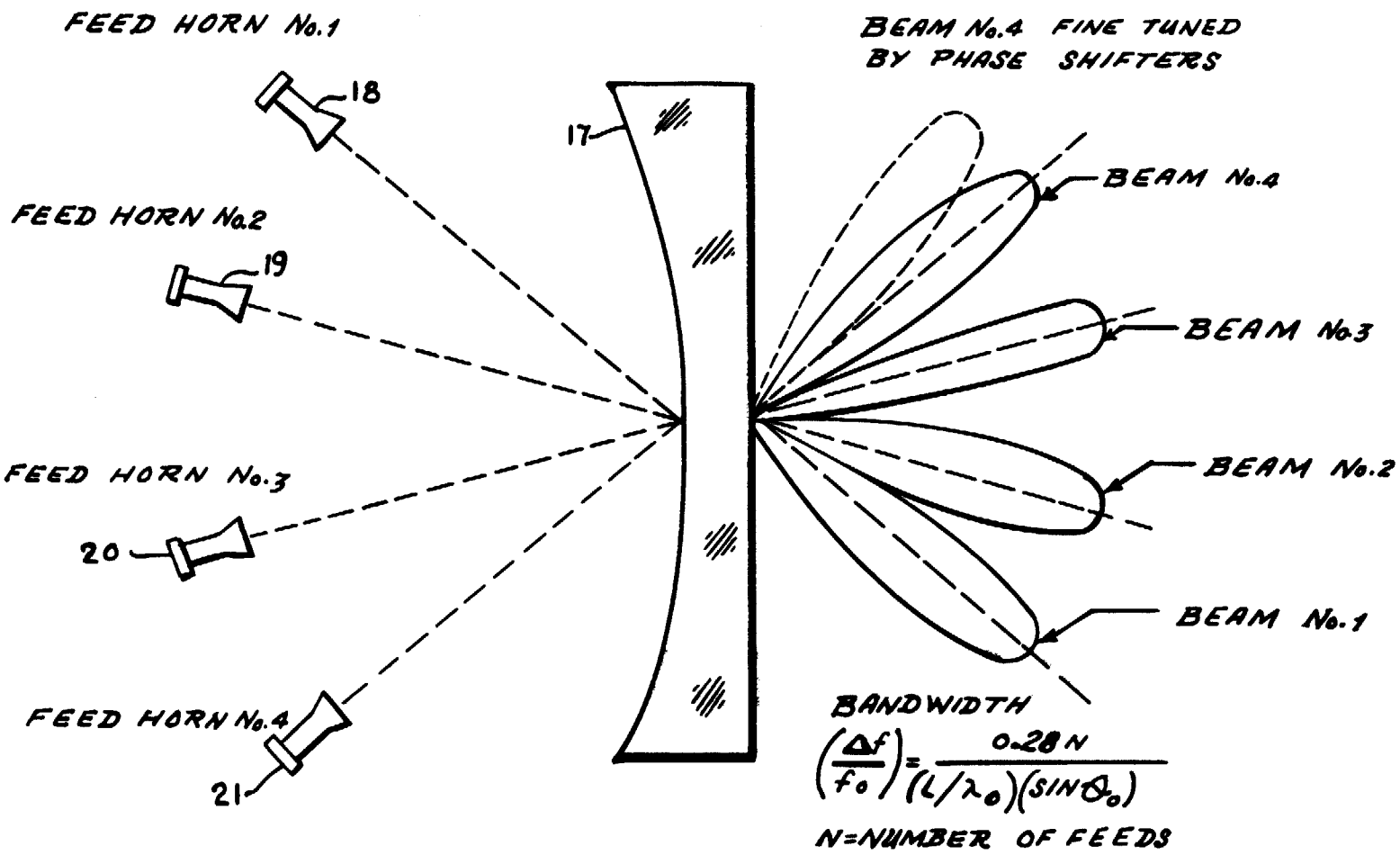
FIG. 2 is a schematic representation of a microwave lens and illustrates beam steering in a multi-fed lens array.

In the following detailed description of the invention design equations for both 2D and 3D lenses are developed. FIG. 1 comprised of constrained lens section 13, phase shifters 14, linear radiating aperture 15 and input horn feed 16 illustrates the effects of bandwidth limitations in space fed phase array antennas. FIG. 2 comprised of microwave lens 17 and horns 18–20 illustrates the basic approach to overcoming this limitation comprehended by the invention. In FIG. 1, the percentage bandwidth of a lens antenna is defined in terms of the maximum scan angle and the antenna dimension L in wavelengths. For example, a sixty wavelength antenna with one feed point and uniform illumination would be restricted to a 0.7 percent bandwidth to cover a total angle of 90°. Likewise, a fifty wavelength antenna would have a 0.9 percent bandwidth. FIG. 2 demonstrates how the combination of a wideband lens with a small number of feeds (in this example, four) can be used with the aperture phase shifters to give a wideband, wide angle, phased array for which the product of the maximum scan angle times the bandwidth increases in proportion to the number of feeds. Consider horn #4 as an example. With all the phase shifters at their zero settings, the angle that beam #4 makes with the array normal is equal to that of horn #4. Small scan perturbations away from this beam position is possible by the use of the phase shifters, without reducing the available bandwidth below the amount given by the equation in FIG. 2.

The basic concept of the invention is illustrated in FIG. 3 which shows four feed horns 23–26 equally spaced along the focal arc of a two-dimensional microwave constrained lens 27 comprising bootlace lens 28, phase shifters 29 and aperture 30. Energy from a transmitter can be directed to any one of the horns by means of the switching tree 22. Each horn, in turn, will form a beam in a different azimuth direction for the zero phase shifter setting. A typical beam for the M'th horn is sketched as the solid curve 31 (M'th Beam) in FIG. 4. When a linear phase shift is added to the aperture illuminated by the phase shifters, the beam scans to either side of its no phase shift position, as illustrated by the dotted curve 32 (Phase scanned M'th Beam). The bandwidth limitation, imposed by this phase scanning, is given by $$\frac{\Delta f}{f_o} = \frac{C}{L/\lambda_o \left( \frac{1}{N} \sin \theta_o \right)} \quad (5)$$

where $\Delta f/fo$ = percentage bandwidth

C = constant (0.28 for uniform illumination; up to (0.46 for tapered illumination)

L = aperture length $\lambda_o$ = wavelength

N = number of feed horns $\theta_o$ = half of azimuthal scan sector

The chosen value of C depends not only upon the aperture illumination but, also, upon the permissible beam quality (side-lobe level) deterioration. Suppose now that it is desired to scan an angular sector from $\theta_0$ to $-\theta_0$. The bandwidth for a single feed horn input is given by Equation 5 with N=1 and $\theta_o=\theta_1$. On the other hand, the scan sector can be divided into N subsectors, each with its own feed horn. In this latter case, the N beams are selected between $-\sin\theta_o$ and $+\sin\theta_o$ so that each beam scans over non-overlapping regions $-\Delta/2$ to $+\Delta/2$ in $\sin\theta$ space (FIG. 5). The bandwidth is then increased, according to Equation 5, in proportion to the number of feed horns.

This conceptual antenna system is constrained to scan in azimuth only. The beam can be narrowed in elevation by using the lens output as a line source feed for a cylindrical lens or reflector. However, in many applications beam steering is required in both planes. The design equations and analysis of a 3D lens antenna which forms focused beams in both azimuth and elevation are hereinafter presented.

Figure 6:
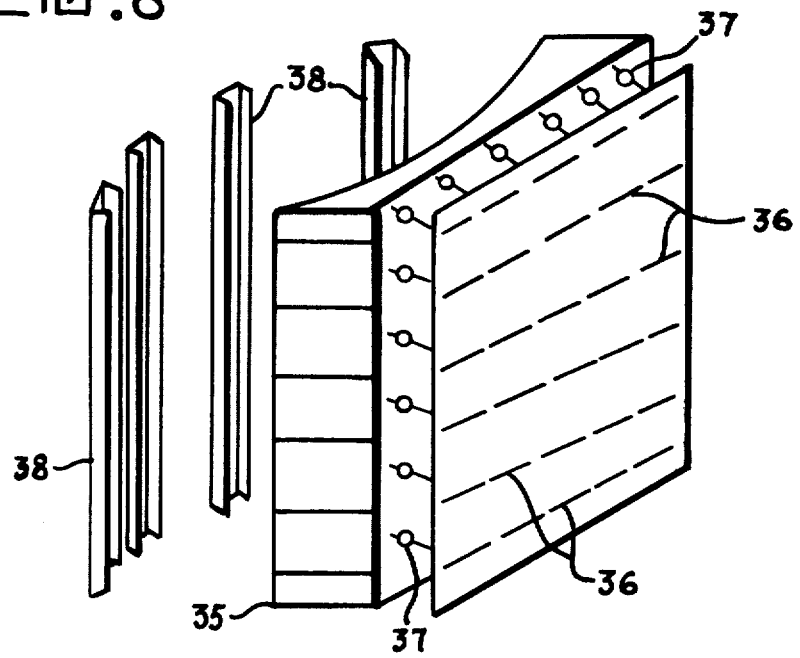
FIG. 6 is an isometric representation of a 3D embodiment of the invention.
Figure 7:
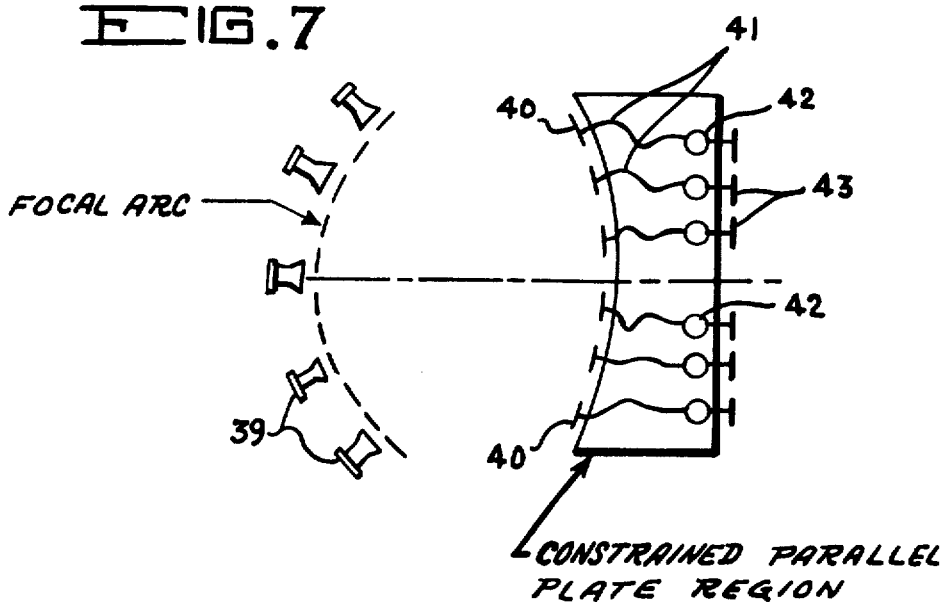
FIG. 7 is a schematic representation of a 2D embodiment of the invention.

The design principles of a 3D cylindrical lens which forms aberrationless beams in azimuth only are now considered. These design principles will be developed with reference to FIGS. 6 and 7. FIG. 6 shows a 3D model comprised of bootlace lens structure 35 radiating elements 36, phase shifters 37 and line source feeds 38. FIG. 7 shows its 2D counterpart and comprises input horn feeds 39, pick up elements 40, transmission lines 41, phase shifters 42 and radiators 43. The 3D antenna may be considered as a vertical stack of identical 2D parallel plate constrained lenses. The outer surface of the 3D lens then becomes a planar array (or, more generally, an array on a cylindrical surface) of radiating elements, each with its own phase shifter. The N feed horns 39, or point source feeds, are likewise replaced by N line source feeds 38 oriented parallel to the cylindrical axis of the lens on the focal surface. The switching network (not shown) connects only one line source feed at a time to the signal source. Each line source feed 38 radiates a cylindrical wave broadside to its longitudinal axis. When the phase shifters 37 are all set for zero phase shift, the lens radiates a narrow beam at an azimuth angle which corresponds to the position of the feed and at zero elevation angle. This beam may then be steered about this central position, by the customary column and row adjustment of the phase shifters, to obtain both azimuth and elevation beam steering. However, the beam steering in elevation will be limited in bandwidth for the reasons mentioned previously. As an example, the total beam coverage is shown in FIG. 8 on a $\phi$ (elevation angle) versus $\theta$ (azimuth angle) plot for a cylindrical lens design ($\phi_o=0°$) with a conjugate pair of perfect off-axis beams at $\theta_1$ and $-\theta_1$ and an on-axis perfect beam at $\theta_o$. The optical aberrations in this lens are small enough so that line source feeds can be placed anywhere along the azimuth focal arc up to and somewhat beyond the limits of $\pm\theta_1$ (as shown by the solid box in FIG. 8) without exceeding the phase tolerances. The beam can then be moved to any desired position within the dashed box bounded by $\theta_{TA}>\theta-\theta_{TA}$ and $\phi_{TA}>\phi>-\phi_{TA}$ by selecting an appropriate feed and using column/row phasor scanning in the lens.

This design is suitable for applications where size and elevation scan angle all lie within the bandwidth constraints:

$$\frac{\Delta f}{fo} = \frac{C}{(L_y/\lambda_o)\sin(\phi_{TA})} \tag{6}$$

where $L_y$ is the height of the aperture. For larger elevation angles, an alternate lens design is possible in which the beam is focused without aberrations for a beam position with both an elevation angle $\phi_1$ and an azimuth angle $\theta_1$. This change requires two modifications to the lens design. First, a progressive phase is introduced along the line source feed so that the phase fronts of its cylindrical radiated wave are tilted at the angle $\phi_1$. This corresponds to the rays emitted from a point on the line source all lying on the surface of a cone with a vertical axis and a half-angle of $90°-\phi_1$. Second, the lens parameters must be redesigned to correspond to these new ray directions so that the three aberrationless beams occur in spatial directions of $(\theta,\phi)=(\theta, \phi_1)$, $(\theta_1, \phi_1)$ and $(\theta_1, \phi_1)$.

From symmetry considerations a second conjugate set of three aberrationless beams must also occur at $(\theta, -\phi_1)$, $(\theta_1, -\phi_1)$ and $(-\theta_1, -\phi_1)$ if the line source feeds are inverted so that the phrase progresses downward rather than upward, giving a total of six aberrationless beams (FIG. 9). Beams with acceptable aberrations can then be formed anywhere within the solid rectangle bounded by $\theta_{TB}>\theta>-\theta_{TB}$ and $\phi_{TB}>\phi>-\phi_{TB}$ in FIG. 9 by selecting an appropriate focal position and progressive phase rate for each line source feed. The beams can be scanned even further (within the dashed box) by adjusting the phase shifters in the planar array, as limited by bandwidth considerations. The elevation scan can potentially be increased over that for the broadside lens design by this means.

One problem that might be expected from this procedure is that two line source feeds at focal locations $(\theta_a, \phi_b)$ and $\theta_a, -\phi_b)$ overlap since they are at the same azimuth location. This can be easily avoided by separating these two feeds slightly in azimuth along the focal surface so that their mutual interaction is negligible (with appropriate phase shifter adjustments for their beam position). An alternate solution is to use multibeam line source feeds, such as the 2D parallel plate constrained lens, for generating the $+\phi_b$ and $-\phi_b$ beams from a single line aperture. This latter type of design can be extended to an antenna system which consists of the cylindrical 3D lens with closely spaced multi-beam line source feeds to provide overlapping beams which cover all directions in both $\theta$ and $\phi$ without the need for phase shifters. However, the switching matrix then becomes more complex as one output is required for each beam position.

Figure 10:
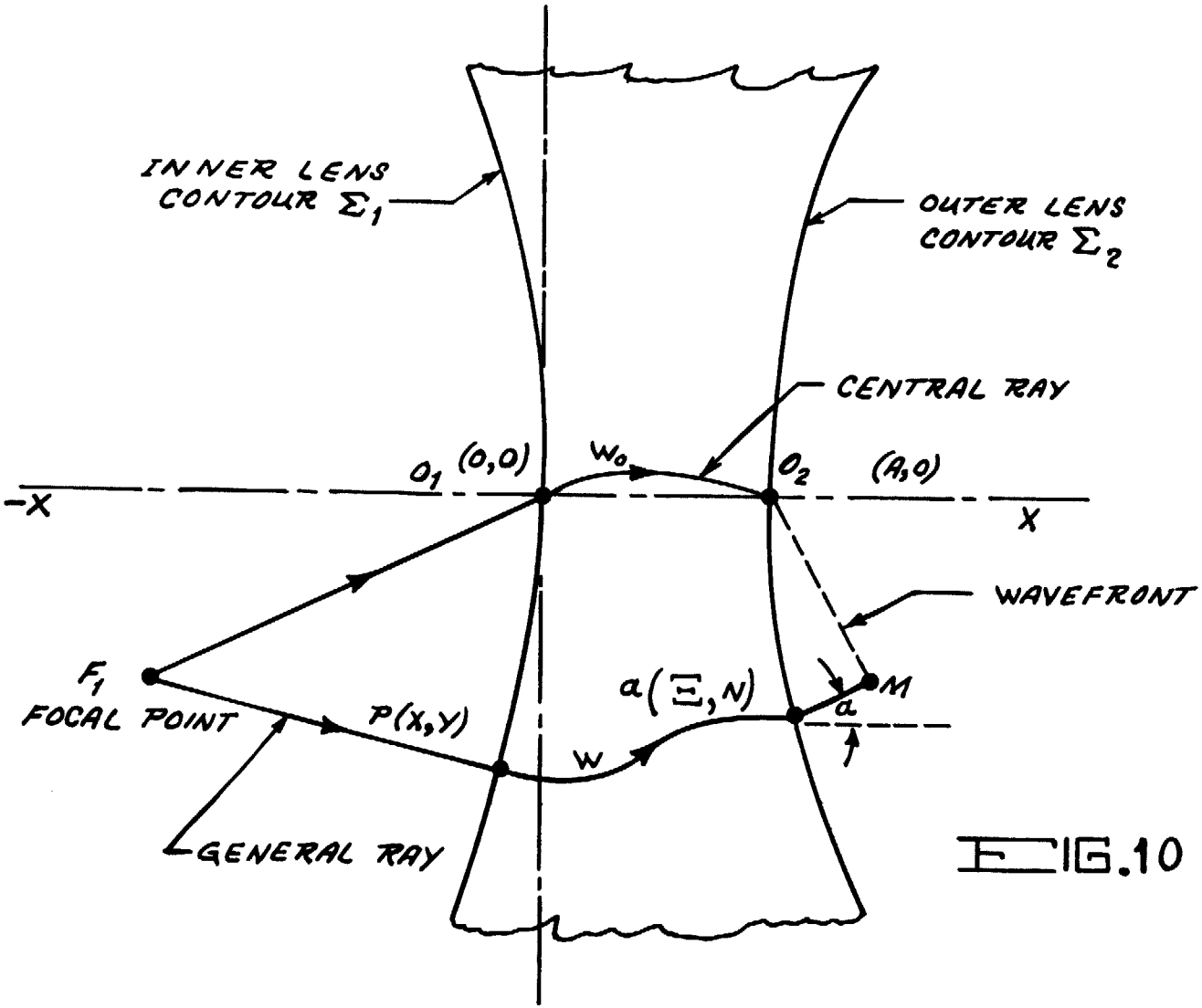
FIG. 10 is a ray trace diagram for a 2D constrained planar lens.
Figure 11:
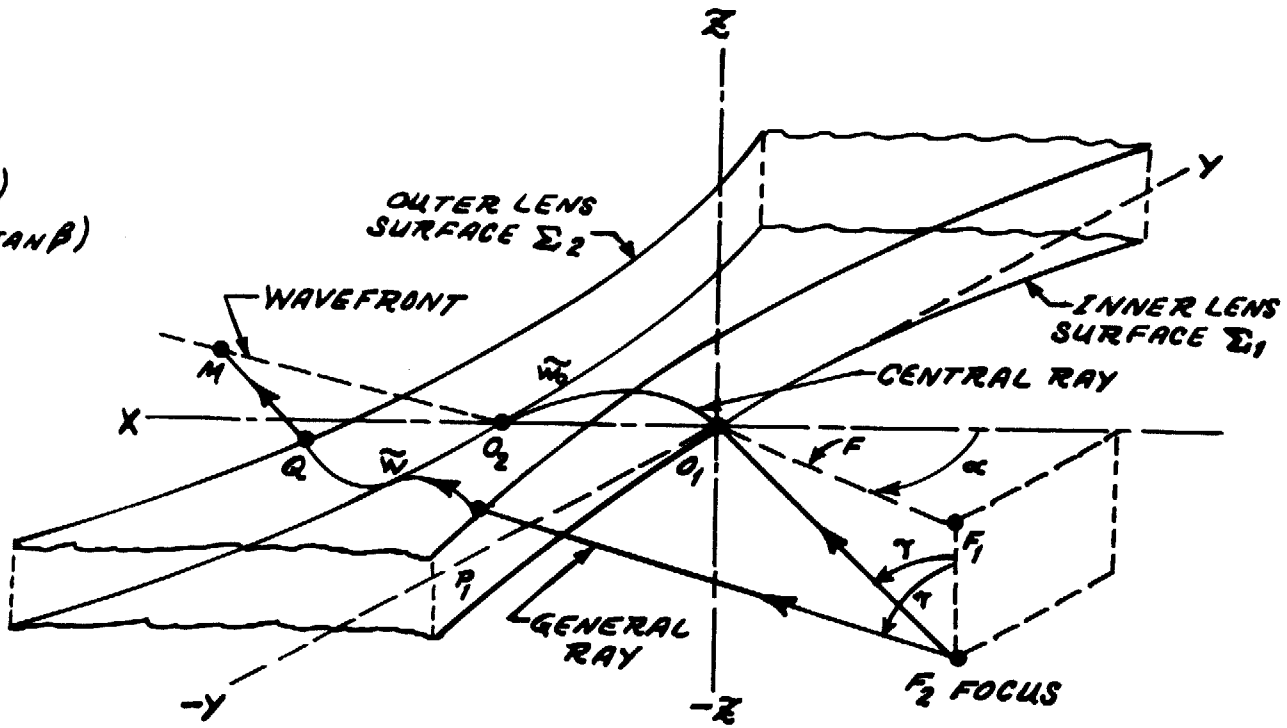
FIG. 11 is a ray trace diagram for a 3D cylindrical lens.

The design equations for the 3D cylindrical lens will next be derived, subject only to the restriction that each of the stack of identical parallel plate 2D lenses which comprise the cylindrical structure be symmetrical and of the general constrained type. This latter condition requires only a one-to-one mapping of points on the inner and outer surfaces of the lens (FIG. 11). It thus includes, for example: (a) the lens with one conjugate pair of off-axis focii, one on-axis focus and a straight outer lens surface (N=Y, $\Xi=0$ in FIG. 10; (b) the Ruze waveguide lens (N=Y, $\Xi=0$, one pair of conjugate focii); (c) the lens with N=Y, $\Xi=0$; F1/F2 and $G_1/G_2$ as two pairs of conjugate focii; and (d) lenses for which the inner lens contour and the focal arc are symmetrical images. For the general 2D constrained lens a set of design equations, each of which equates the length $L_g$ of a general ray to that of the central ray L from a focal point to a wavefront, may be written in the form (see FIG. 10 for notation):

$$\overrightarrow{F_1P}+W-\Xi\cos\alpha+N\sin\alpha=F+W_o-A\cos\alpha \quad (7)$$

An expression is now derived, similar to equation 7, for the ray path difference in the 3D cylindrical microwave lens, using the same variables whenever possible. The principal differences are the addition of a Z dimension for the cylindrical axis of the lens and of an elevation angle $\beta$. The direction of each beam is then specified by the azimuth and elevation angles ($\alpha$, $\beta$).

In the ray tracing procedure, the rays are all assumed to originate from a point on the line source feed at an angle of $\gamma=90°-\beta$ with the Z axis. The central and a general ray, emanating from a point $F_2$ on one of the line source feeds, are shown traced through the lens in FIG. 11. The central ray intercepts the inner contour of the lens at the origin (O, O, O) of a Cartesian coordinate system (X, Y, Z). The coordinates of the off-axis focus $F_2$ are located at ($-F\cos\alpha$, $F\sin\alpha$, $-F\tan\beta$). Equality of the central and general ray results in the relation:

$$\overrightarrow{F_2P_1}+\tilde{W}+\overrightarrow{QM}=\overrightarrow{F_2O_1}+\tilde{W}_o \quad (8)$$

where $$\overrightarrow{F_2P_1}=\overrightarrow{F_1P_1}\sec\beta \quad (9)$$

$$\overrightarrow{F_2O_1}=F\sec\beta\ (F=\overrightarrow{F_1O_1}) \quad (10)$$

The line segment $\overrightarrow{QM}$ is evaluated as the distance from a point Q, located on the outer lens surface, $\Sigma_2(\Xi_1, N_1, Z_1)$ to the wavefront plane which is tilted relative to the YZ plane at an azimuth angle $\alpha$ and elevation angle $\beta$ and also, passes through the point $O_2$ at (A, O, O). If $P_o(\Xi_o, N_o, Z_o)$ is a point on a plane and $N=A\bar{i}+\bar{B}j+\bar{C}k=\bar{i}\cos\theta+\bar{j}\cos\theta+\bar{k}\cos\phi$ is the vector N normal to the plane, then the equation of the plane is $$A(\Xi-\Xi_o)+B(N-N_o)+C(Z-Z_o)=0 \quad (11)$$

Figure 12:
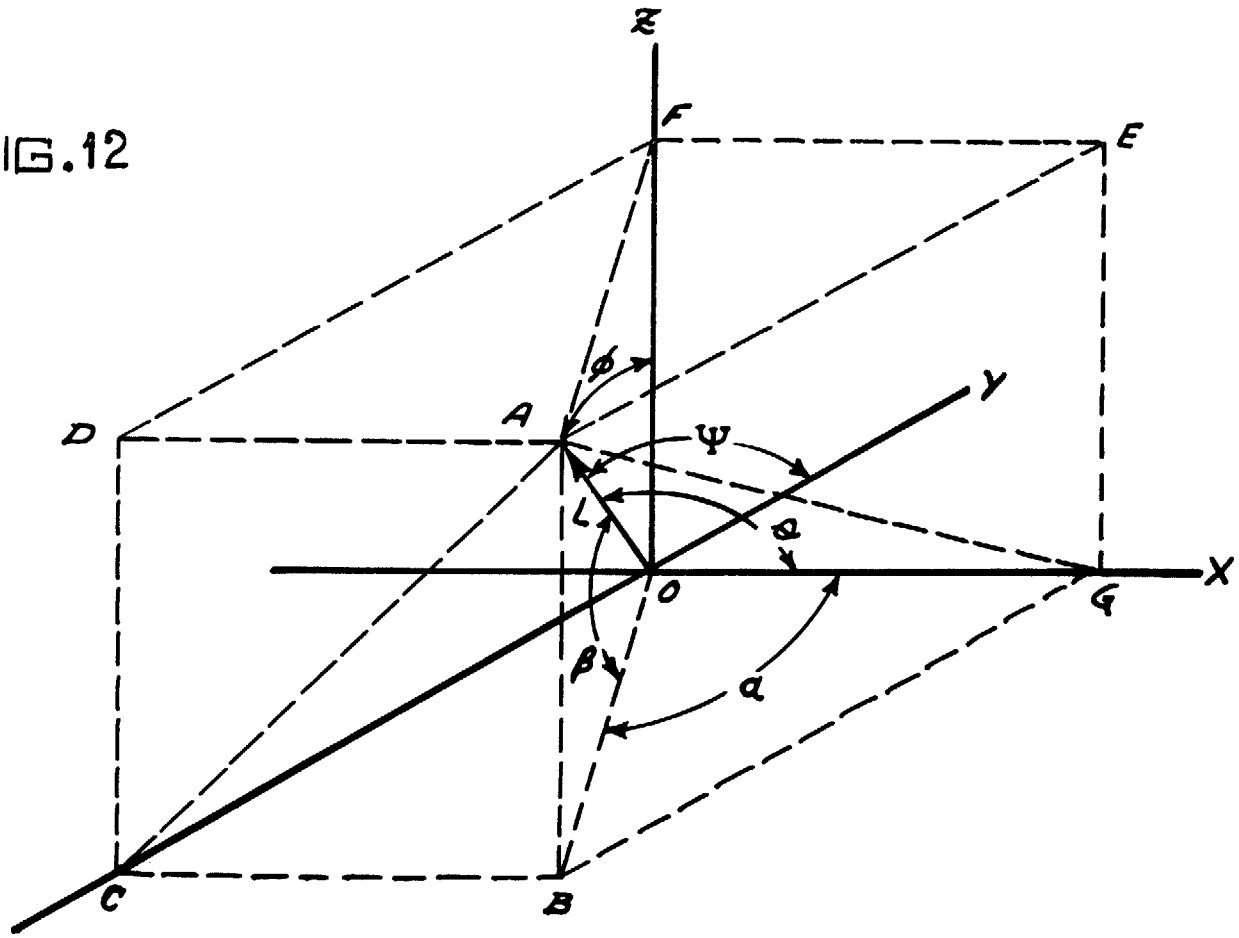
FIG. 12 is a diagram showing the transformation of angular coordinates.

For $P_o(\Xi_o, N_o, Z_o)=(A, O, O)$, Eq. 7 becomes $$(\Xi-A)\cos\theta+Y\cos\psi+Z\cos\phi=0 \quad (12)$$

where $\cos\theta$, $\cos\psi$ and $\cos\phi$ are directional angles relative to the coordinate axis (FIG. 12). The distance $\overline{QM}$ from the point Q at ($\Xi_1$, $N_1$, $Z_1$) to the plane defined by Equation 12 is:

$$\overrightarrow{QM}=-[(\Xi_1-A)\cos\theta+N_1\cos\psi+Z_1\cos\phi)] \quad (13)$$

From FIG. 11:

$$Z_1=(\overrightarrow{F_1P_1}-F)\tan\beta \quad (14)$$

The relation between the azimuth and elevation angles and the directional angles are given by (FIG. 12):

$$\cos\theta=\cos\beta\cos\alpha \quad (15)$$

$$\cos\psi=-\cos\beta\sin\alpha \quad (16)$$

$$\cos\phi=\sin\beta \quad (17)$$

Combining equations 13 through 17: (18)

$$\overrightarrow{QM}=-[(\Xi_1-A)\cos\beta\cos\alpha-N_1\cos\beta\sin\alpha+(\overrightarrow{F_1P_1}-F)\sin^2\beta\sec\beta]$$

Combining equations 8, 9, 10 and 18 the relation for the equality of the central ray of length $L_e$ and a general ray of length $L_g$ becomes:

$$L_g-L_c=(\overrightarrow{F_1P}-F)(1-\sin^2\beta)\sec\beta+(\tilde{W}-\tilde{W}_o)-(\Xi_1-A)\cos\beta\cdot\cos\alpha+N_1\cos\beta\sin\alpha=0 \quad (19)$$

or $$\overrightarrow{F_1P}+(\tilde{W}-\tilde{W}_o)\sec\beta-(\Xi_1-A)\cos\alpha+N_1\sin\alpha=F \quad (20)$$

Comparison of equation 20 for the 3D cylindrical lens with equation 7 for the 2D planar lens shows that they are identical under the transformation:

$$\hat{W}=(\tilde{W}-\tilde{W}_o)=(W-W_o)\cos\beta \quad (21)$$

The conclusion obtained from this derivation is that the design for a 3D cylindrical lens may be obtained from an equivalent 2D constrained lens design by simply changing the transmission line lengths W to new values $\tilde{W}$ in accordance with equation (21). This transformation does not change the shape of either the inner or outer lens contours. It applies to any constrained 2D lens which may be described by a set of equations of the form of equation 7, which includes designs for which the outer lens contour is not straight. It also includes waveguide types where W is defined as the optical path length in the waveguide.

A relation will now be derived for the path length difference, $\tilde{L}$, between the central ray and a general ray when the line source feed is not at a location of perfect focus. For the 2D case, the path length equality of equation 7 no longer holds and is replaced by $$L_g-L=\Delta L_{2D}=(\overrightarrow{F_1P}-F)+(W-W_o)-(\Xi-A)\cos\alpha+N\sin\alpha \quad (22)$$

A similar equation (related to equation 19) may be written for the 3D cylindrical lens which is designed for an elevation angle $\beta_o$:

$$\tilde{L}_g-\tilde{L}_c=\tilde{\Delta}L=[(\overrightarrow{F_1P}-F)-(\Xi-A)\cos\alpha+N\sin\alpha]\cos\beta+(W-W_o) \quad (23)$$

Equations 21, 22 and 23 combine to give an expression for the path length errors $\tilde{\Delta}L$ in a cylindrical 3D lens operating at an elevation angle $\beta$ and derived from a 2D lens which has path length errors $\Delta L_{2D}$:

$$\tilde{\Delta}L=\Delta L_{2D}\cos\beta+(W-W_o)(\cos\beta_o-\cos\beta) \quad (24)$$

Equation 24 gives a simple method of evaluating the path length errors in a 3D lens from a knowledge of its 2D counterpart. The factor $(W-W_o)(\cos\beta_o-\cos\beta)$ reflects the fact that the transmission line lengths are selected for a design elevation angle $\beta_o$, rather than for the operating angle $\beta$, from the relation $\hat{W}=(\tilde{W}-\tilde{W}_o)=(W-W_o)\cos\beta_o$. The contribution of the factor $\Delta L_{2D}\cos\beta$ to $\tilde{\Delta}L$ is always less than the value $\Delta L_{2D}$ (path length differences in the 2D lens). In particular, if a 2D design can be found for which $W=W_o$, then $\tilde{\Delta}L=\Delta L_{2D}\cos\beta$ and path length errors for the 3D design would always be less than that for the 2D design at any elevation angle. A design for a 2D lens with this constraint will next be developed.

The particular 2D lens configuration to be investigated has one conjugate pair of off-axis focii ($F_1$ and $F_2$) at angles $\pm\alpha$ to the x axis and one on-axis focus ($G_1$). Also, all transmission line lengths in the lens are identical ($W=W_o$). These constraints require that the outer contour of the lens be curved ($\Xi-A=O$). Three equations, one for each of the three focal points, are now written in the form of equation 7:

$$\overrightarrow{F_1P}-\Xi\cos\alpha+N\sin\alpha=F \quad (25)$$

$$\overrightarrow{F_2P}-\Xi\cos\alpha-N\sin\alpha=F \quad (26)$$

$$\overrightarrow{G_1P}-\Xi=G \quad (27)$$

where $$(\overrightarrow{F_1P})^2=F^2+X^2+Y^2+2FX\cos\alpha-2FY\sin\alpha \quad (28)$$

$$(\overrightarrow{F_2P})^2=F^2=X^2+Y^2+2FX\cos\alpha+2FY\sin\alpha \quad (29)$$

$$(\overrightarrow{G_1P})^2=(G+X)^2+Y^2 \quad (30)$$

Equations 28 and 29 are substituted into equations 25 and 26 to give:

$$y=\eta(1+\xi\cos\alpha) \quad (31)$$

and $$x^2+y^2+2x\cos\alpha=\xi^2\cos^2\alpha+\eta^2\sin^2\alpha+2\xi\cos\alpha \quad (32)$$

where $$x=X/F,\ y=Y/F,\ \xi=\Xi/F,\ \eta=N/F,\ g=G/F.$$

Similarly, combining equations 32 and 33 for the on-axis focus:

$$x^2+y^2+2gx=\xi^2+2g\xi \quad (33)$$

Subtracting equations 29 and 30, we obtain:

$$x=\frac{(\xi^2-\eta^2)\sin^2\alpha}{2(g-\cos\alpha)}+\xi \quad (34)$$

substituting equation 31 and 34 into equation 33:

$$\frac{1}{2}\left[\frac{(\xi^2-\eta^2)\sin^2\alpha}{g-\cos\alpha}+\xi\right]^2+\eta^2(1+\xi\cos\alpha)^2+2g\left[\frac{1}{2}\ \frac{(\xi^2-\eta^2)\sin^2\alpha}{g-\cos\alpha}+\xi\right]=\xi^2+2g\xi \quad (35)$$

Expanding the quadratic terms, equation 35 becomes after some algebraic manipulation:

$$\tfrac{1}{4}[p^2]\xi^4+[p]\xi^3+[\{\cos^2\alpha-\tfrac{1}{2}p^2\}\eta^2+pg]\xi^2+[\{2\cos\alpha-p\}\eta^2]\xi+[\tfrac{1}{4}p^2\eta^4+\{1-pg\}\eta^2]=0 \quad (36)$$

where $p=\sin^2\alpha/g-\cos\alpha$.

Equation 36 can be solved for $\xi$ as a function of $\eta$ for a given set of lens design parameters (g and $\alpha$). These values can then be substituted into equations 31 and 34 to give x and y. This completes the solution for the lens design.

This procedure gives a lens which has three perfect focus points corresponding to the angles $\pm\alpha$ and $\theta°$. For wide angle scanning the lens must focus well not only at these three points, but also at all intermediate angles along the focal arc. The value of the factor g which minimizes the overall phase aberrations in the Ruze lens design ($y=\eta$) and is a good choice for the Gent design ($y\neq\eta$; $w-w_o=0$) may also be expected to be close to optimum for the present design, giving:

$$g=G/F\approx 1+\alpha^2/2 \quad (37)$$

The focal arc is chosen as aportion of a circle of radius R, which passes through the two symmetrical off-axis and one on-axis focal points.

Preliminary analysis indicates that the value of g which is selected in accordance with equation 37 gives a practical lens design in that the other lens contour is reasonably flat ($\xi$ small) and optical aberrations from intermediate points along the focal arc within useful limits.

Although the invention has been described with reference to a particular embodiment, it will be understood to those skilled in the art that the invention is capable of a variety of alternative embodiments within the spirit and scope of the appended claims.

What is claimed is:

1. A three dimensional space fed wideband scanning microwave antenna comprising:

a multiplicity of two dimensioned parallel plate contrained cylindrical lens elements arranged in a vertical stack to effect a three dimensional cylindrical lens, each said two dimensional parallel plate constrained cylindrical lens elements including a linear array of n pickup elements disposed along the inner surface thereof, a liner array of n radiating elements disposed along the outer surface thereof, each radiating element having a corresponding substantially adjacent pick up element, and a transmission line connecting each radiating element with its corresponding pick up element, A plurality of discrete feeds positioned in spaced relationship in an arc having substantially the same radius as the focal arc of said three dimensional cylindrical lens, said plurality of discrete feeds being spaced from and oriented to illuminate the inner surface of said three dimensional cylindrical lens whereby pick up elements can be illuminated from different directions along the arc of feeds to effect beam radiation from said radiating elements in the same direction, an input for receiving the output of a microwave transmitter, and switch means for selectively connecting any one of said discrete feeds to said input whereby the sequential connecting of feeds effects scanning of a beam radiating from said radiating elements.

2. A three dimensional space fed wideband scanning microwave antenna as defined in claim 1 including phase shift means in each said transmission line.

3. A three dimensional space fed wideband scanning microwave antenna as defined in claim 2 wherein each said feed member comprises a line source feed oriented parallel to the cylindrical axis of said cylindrical lens means.

4. A three dimensional space fed wideband scanning microwave antenna as defined in claim 3 wherein said transmission lines have lengths that effect elevational scanning in response to progressively phased operation of said feed members.

5. A three dimensional space fed wideband scanning microwave antenna as defined in claim 4 wherein said transmission lines have lengths determined by the transfer equation $W=(W-W_o)=(W-W_o)\cos\beta$, where W is the general ray, $W_o$ is the central ray and $\beta$ is the elevation scan angle.

6. A three dimensional space fed wideband scanning microwave antenna as defined in claim 5 wherein all said transmission lines are of equal length.

* * * * *